US008267173B2

(12) United States Patent
Clarkson et al.

(10) Patent No.: US 8,267,173 B2
(45) Date of Patent: Sep. 18, 2012

(54) OPEN HOLE COMPLETION APPARATUS AND METHOD FOR USE OF SAME

(75) Inventors: Brad A. Clarkson, Fulshear, TX (US); Ronnie Burger, Pearland, TX (US); Bruce Techentien, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 504 days.

(21) Appl. No.: 12/469,134

(22) Filed: May 20, 2009

(65) Prior Publication Data

US 2010/0294495 A1 Nov. 25, 2010

(51) Int. Cl.

| | |
|---|---|
| ***E21B 43/04*** | (2006.01) |
| ***E21B 33/00*** | (2006.01) |
| ***E21B 43/26*** | (2006.01) |
| ***E21B 43/00*** | (2006.01) |

(52) U.S. Cl. ..... 166/278; 166/205; 166/316; 166/308.1

(58) Field of Classification Search ..... 166/51, 166/177.5, 191, 205, 208, 305, 308, 380, 166/382, 385, 278, 316, 308.1, 305.1
See application file for complete search history.

(56) References Cited

U.S. PATENT DOCUMENTS

| | | | | | |
|---|---|---|---|---|---|
| 3,999,608 | A | * | 12/1976 | Smith | 166/278 |
| 4,273,190 | A | * | 6/1981 | Baker et al. | 166/278 |
| 4,683,955 | A | | 8/1987 | Stepp et al. | |
| 4,712,619 | A | | 12/1987 | Stepp et al. | |
| 4,944,348 | A | * | 7/1990 | Whiteley et al. | 166/278 |
| 5,492,178 | A | | 2/1996 | Nguyen et al. | |
| 5,522,458 | A | | 6/1996 | Watson et al. | |
| 5,647,434 | A | | 7/1997 | Sullaway et al. | |
| 5,697,442 | A | | 12/1997 | Baldridge | |
| 5,722,491 | A | | 3/1998 | Sullaway et al. | |
| 5,829,526 | A | | 11/1998 | Rogers et al. | |
| 6,230,801 | B1 | * | 5/2001 | Hill et al. | 166/278 |
| 6,446,729 | B1 | * | 9/2002 | Bixenman et al. | 166/386 |
| 6,464,006 | B2 | * | 10/2002 | Womble | 166/276 |
| 6,488,082 | B2 | | 12/2002 | Echols et al. | |
| 6,513,599 | B1 | * | 2/2003 | Bixenman et al. | 166/378 |
| 6,513,958 | B2 | | 2/2003 | Ishikawa | |
| 6,588,507 | B2 | * | 7/2003 | Dusterhoft et al. | 166/278 |
| 6,626,241 | B2 | | 9/2003 | Nguyen | |
| 6,772,841 | B2 | | 8/2004 | Gano | |
| 6,782,948 | B2 | | 8/2004 | Echols et al. | |
| 6,932,157 | B2 | * | 8/2005 | McGregor et al. | 166/278 |
| 7,066,265 | B2 | | 6/2006 | Surjaatmadja | |
| 7,234,522 | B2 | | 6/2007 | Johnson et al. | |
| 7,299,876 | B2 | | 11/2007 | Lord et al. | |

(Continued)

*Primary Examiner* — Kenneth L Thompson
*Assistant Examiner* — Michael Wills, III
(74) *Attorney, Agent, or Firm* — Lawrence R. Youst

(57) ABSTRACT

An open hole completion apparatus (80) includes an outer tubing string (56) disposed in an open hole portion of a wellbore (32). The outer tubing string (56) includes a sand control screen (102) and a shrouded closing sleeve (91). An inner tubing string (84) is at least partially disposed within the outer tubing string (56). The inner tubing string (84) includes a crossover assembly (114). The shrouded closing sleeve (91) has a shroud (92) that creates a channel (98) with a portion of the outer tubing string (56) by extending over a fluid port (94) of the shrouded closing sleeve (91) toward the sand control screen (102), such that when a treatment fluid is pumped through the inner tubing string (84), the crossover assembly (114) and the fluid port (94), the treatment fluid is injected into the wellbore (32) remote from the fluid port (94).

19 Claims, 3 Drawing Sheets

U.S. PATENT DOCUMENTS

| | | | | |
|---|---|---|---|---|
| 7,413,017 | B2 | 8/2008 | Nguyen et al. | |
| 2002/0189808 | A1* | 12/2002 | Nguyen et al. | 166/278 |
| 2002/0195253 | A1* | 12/2002 | Hill et al. | 166/380 |
| 2003/0000699 | A1* | 1/2003 | Hailey, Jr. | 166/278 |
| 2003/0047311 | A1* | 3/2003 | Echols et al. | 166/278 |
| 2005/0082060 | A1* | 4/2005 | Ward et al. | 166/278 |
| 2006/0042795 | A1* | 3/2006 | Richards | 166/278 |
| 2007/0051507 | A1* | 3/2007 | Ross et al. | 166/51 |
| 2009/0025923 | A1* | 1/2009 | Patel et al. | 166/51 |
| 2009/0095471 | A1* | 4/2009 | Guignard et al. | 166/278 |

* cited by examiner

OPEN HOLE COMPLETION APPARATUS AND METHOD FOR USE OF SAME

TECHNICAL FIELD OF THE INVENTION

This invention relates, in general, to completing a wellbore that traverses a subterranean hydrocarbon bearing formation and, in particular, to an open hole completion apparatus and method for use of same.

BACKGROUND OF THE INVENTION

Without limiting the scope of the present invention, its background will be described in relation to fracpack and gravel pack systems for use in completing wellbores in open hole subterranean hydrocarbon bearing formations, as an example.

Fracpacks and gravel packs are commonly performed during the completion of oil and gas wells. During these operations, a completion string including one or more sand control screens is typically run downhole and positioned adjacent to the production interval. A service tool is positioned inside of the completion string to provide a conduit for pumping fluids downhole.

In general, the fracpack operation is used to stimulate well production by pumping liquid under high pressure down the well into the reservoir rock adjacent to the wellbore to create fractures therein. Propping agents or proppants suspended in the high-pressure fluids are used to keep the fractures open, thus facilitating increased flow into the wellbore. In addition, the proppants fill the annulus between the screens and the casing to provide a first layer of filtration, which restricts formation sand migration. The gravel pack operation is commonly used in unconsolidated or loosely consolidated reservoirs for sand control. The gravel pack slurry is pumped down the well into the annulus between the screens and the casing while taking fluid returns to the surface, thereby minimizing fluid loss into the formation. The gravel pack provides a packed sand layer in the wellbore, which restricts formation sand migration.

It has been found, however, that for certain completions, installation of casing and the associated cementing process may be undesirable. For example, in deepwater wells, it may be preferable to complete the wells open hole. One reason for this preference is the risk of experiencing a problem in a cased hole completion that requires the completion to be abandoned. In such a situation, an alternative wellbore may be sidetracked from the existing cased hole wellbore, however, the subsequent wellbore must be completed using smaller diameter equipment. This reduction in hole size not only limits production capabilities but also diminishes the ability to perform desired treatment operations, such as fracpack operations, as the service tool ratings for the smaller diameter tools limits the flow rates and proppants volumes that can be delivered. One way to avoid this problem and to maintain the larger hole size even when a sidetrack is required, is by completing the wells open hole.

It has been found, however, the certain problems arises when gravel packing or fracpacking in open hole environments. For example, when the gravel pack or fracpack slurry is pumped out of the crossover assembly and the closing sleeve, the slurry immediately come in contact with the formation. As the slurry is commonly injected at a location uphole of the particular zone of interest, the liquid portion of the slurry may leak off into an undesired portion of the formation, which dehydrates the slurry and may cause sand bridges to form in the wellbore. These sand bridges not only result in a failed pack but may also cause the service tool to become stuck within the completion string if the slurry dehydration takes place proximate to and inside the closing sleeve.

Therefore, a need has arisen for a system and method of completing open hole wells. A need has also arisen for such a system and method that allows for formation stimulation and sand control in open hole completions. Further, need has arisen for such a system and method that prevents slurry dehydration proximate to and inside the closing sleeve during such treatment operations.

SUMMARY OF THE INVENTION

The present invention disclosed herein comprises a system and method of completing open hole wells. The system and method of the present invention allows for formation stimulation and sand control in open hole completions and prevents slurry dehydration proximate to and inside the closing sleeve during such treatment operations.

In one aspect, the present invention is directed to an open hole completion apparatus for use in a wellbore. The apparatus includes an outer tubing string that is at least partially disposed in an open hole portion of the wellbore. The outer tubing string includes at least one sand control screen and a shrouded closing sleeve having at least one fluid port. An inner tubing string is at least partially disposed within the outer tubing string. The inner tubing string includes a crossover assembly having at least one fluid port that is selectively in fluid communication with the at least one fluid port of the shrouded closing sleeve. The shrouded closing sleeve has a shroud that creates a channel with a portion of the outer tubing string by extending over the at least one fluid port of the shrouded closing sleeve toward the at least one sand control screen. With this configuration, when a treatment fluid, such as a fracpack fluid slurry or a gravel pack fluid slurry, is pumped through the inner tubing string, the crossover assembly and the at least one fluid port of the shrouded closing sleeve, the treatment fluid is injected into the wellbore remote from the at least one fluid port of the shrouded closing sleeve.

In one embodiment, the outer tubing string includes first and second packers that are disposed respectively uphole and downhole of the at least one sand control screen and the shrouded closing sleeve that provide zonal isolation for the system. In another embodiment, the shrouded closing sleeve includes a closing sleeve operable to allow and prevent fluid communication between the at least one fluid port of the crossover assembly and the at least one fluid port of the shrouded closing sleeve. In this embodiment, the inner tubing string may be used to operate the closing sleeve between the open and closed positions.

In one embodiment, the shroud, which may be a thin-walled tubular member, directs the treatment fluid in a downhole direction in the channel, which may be substantially annular. In another embodiment, the shroud extends downhole to a location proximate a first end of the at least one sand control screen, such that when the treatment fluid is pumped through the inner tubing string, the crossover assembly and the at least one fluid port of the shrouded closing sleeve, the treatment fluid is injected into the wellbore proximate the first end of the at least one sand control screen.

In another aspect, the present invention is directed to a shrouded closing sleeve for completing an open hole wellbore. The shrouded closing sleeve includes a tubular housing having at least one fluid port in a sidewall portion thereof. A closing sleeve is operable to allow and prevent fluid communication through the at least one fluid port. A shroud, disposed exteriorly of the tubular housing, creates a channel with a portion of the tubular housing by extending over the at least one fluid port in a first direction, such that when a treatment fluid is pumped from an interior to an exterior of the tubular housing through the at least one fluid port, the treatment fluid travels in the first direction in the channel.

In a further aspect, the present invention is directed to a method for completing an open hole wellbore. The method includes setting a plurality of packers to isolate at lease one zone, pumping a treatment fluid through an inner tubing string, a crossover assembly and at least one fluid port of a shrouded closing sleeve, directing the treatment fluid away from the at least one fluid port in a channel created by a shroud of the shrouded closing sleeve and injecting the treatment fluid into the wellbore remote from the at least one fluid port. The method may be repeated for each of the isolated zones by relocating the inner tubing string, including the crossover assembly, relative to other shrouded closing sleeves and zones in the wellbore.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Additionally, the term "upstream" refers to a direction farther from the bottom or end of the wellbore, whether it be vertical, slanted, or horizontal; and the term "downstream" refers to a direction closer to the bottom or end of the wellbore, whether it be vertical, slanted, or horizontal.

Figure 1:
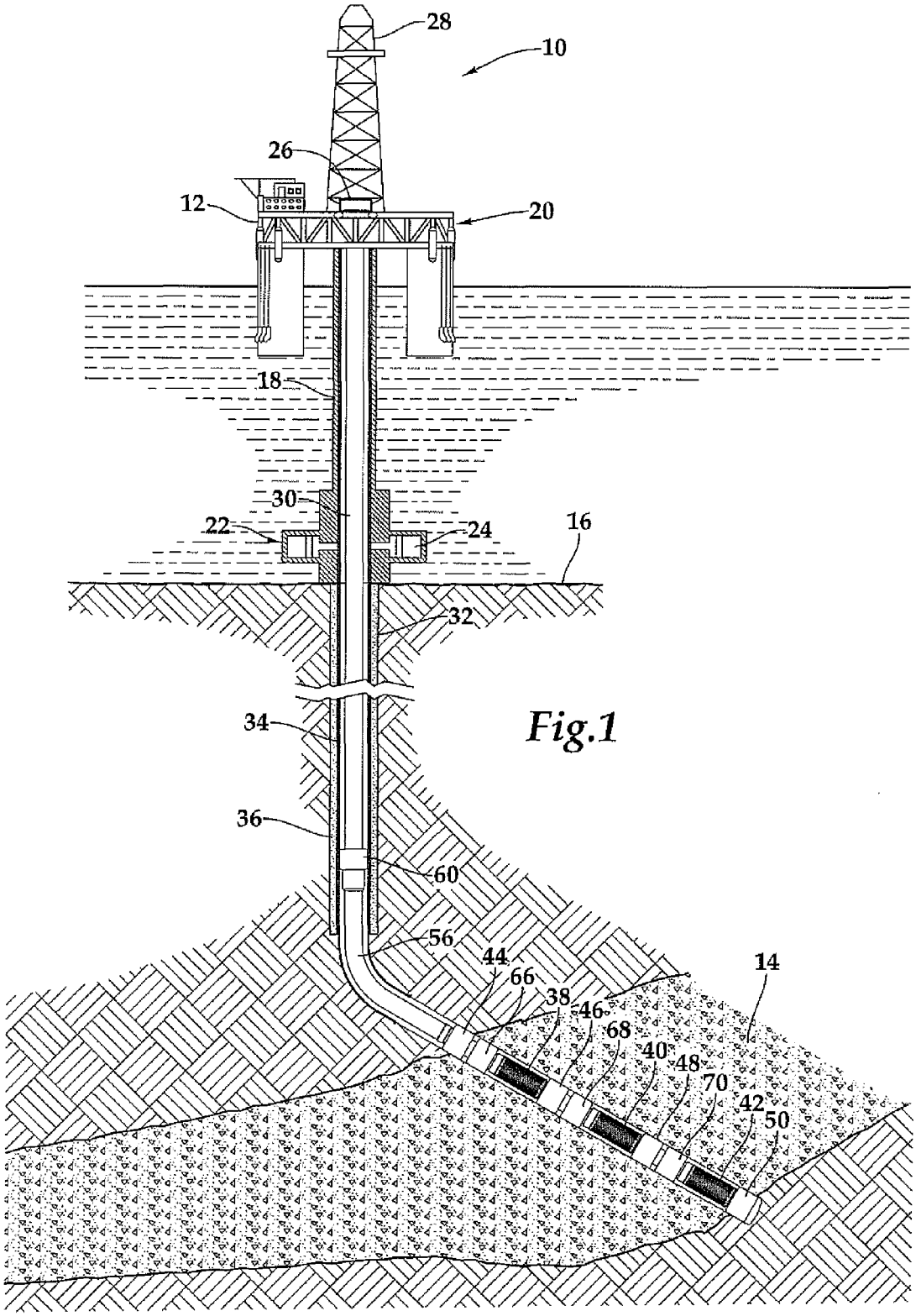
FIG. 1 is a schematic illustration of an offshore oil and gas platform operating an open hole completion apparatus that embodies principles of the present invention.

Referring initially to FIG. 1, several open hole fracpack mechanisms that are deployed in an offshore oil or gas well are schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings, such as a substantially tubular, longitudinally extending work string referred to herein as an inner tubing string 30.

Importantly, even though FIG. 1 depicts a slanted well, it should be understood by one skilled in the art that the open hole fracpack mechanisms of the present invention are equally well-suited for use in vertical wells, horizontal wells, multilateral wells and the like. Also, even though FIG. 1 depicts an offshore operation, it should be understood by one skilled in the art that the open hole fracpack mechanisms of the present invention are equally well-suited for use in onshore operations.

Continuing with FIG. 1, a wellbore 32 extends through the various earth strata including formation 14. A casing 34 is cemented within a vertical section of wellbore 32 by cement 36. An upper end of a completion string, referred to herein as an outer tubing string 56 is secured to the lower end of casing 34 by a liner hanger 60 or other suitable support mechanism.

Note that, in this specification, the terms "liner" and "casing" are used interchangeably to describe tubular materials, which are used to form protective linings in wellbores. Liners and casings may be made from any material such as metals, plastics, composites, or the like, may be expanded or unexpanded as part of an installation procedure, and may be segmented or continuous. Additionally, it is not necessary for a liner or casing to be cemented in a wellbore. Any type of liner or casing may be used in keeping with the principles of the present invention.

Outer tubing string 56 may include one or more packers 44, 46, 48, 50 that provide zonal isolation for the production of hydrocarbons in certain zones of interest within wellbore 32. When set, packers 44, 46, 48, 50 isolate zones of the annulus between wellbore 32 and outer tubing string 56. In this manner, formation fluids from formation 14 may enter the annulus between wellbore 32 and outer tubing string 56 in between packers 44, 46, between packers 46, 48, and between packers 48, 50. Additionally, fracpack and gravel pack slurries, also known as proppant slurries, may be pumped into the isolated zones provided therebetween.

In addition, outer tubing string 56 includes sand control screen assemblies 38, 40, 42 that are located near the lower end of tubing string 56 and substantially proximal to formation 14. As shown, packers 44, 46, 48, 50 may be located above and below each set of sand control screen assemblies 38, 40, 42.

Further, outer tubing string 56 includes shrouded closing sleeves 66, 68, 70 that provided a pathway such as a channel or an annular area that prevents proppant slurry from contacting the surface of formation 14 until the proppant slurry travels downhole to a desired location, such as near or proximal to one of screen control screen assemblies 38, 40, 42. Preferably, shrouded closing sleeves 66, 68, 70 are each located in a zone of interest defined by packers 44, 46, 48, 50.

It should be understood by those skilled in the art that the open hole fracpack mechanisms of the present invention may be used in a wellbore having any number of zones of interest. For example, FIG. 1 shows three zones of interest while FIGS. 2A-2B and 3A-3B show two zones of interest. Further, the open hole fracpack mechanisms of the present invention may be used in a wellbore having a single zone of interest if desired.

Referring now to FIGS. 2A-2B and 3A-3B, detailed cross-sectional views of successive axial portions of open hole fracpack mechanism 80 are representatively illustrated. Outer tubing string 56 is secured to casing 34 with a liner hanger that is illustrated as a gravel pack setting packer 82. Gravel pack setting packer 82 includes slip assemblies and seals as well as other devices that are known to those skilled in the art for providing a sealing and gripping relationship between outer tubing string 56 and casing 34. Additionally, gravel pack setting packer 82 may be any type of packer, such as mechanical set, hydraulically set or hydrostatic set packers as well as swellable packers, for example.

An annulus 86 is formed between casing 34 and outer tubing string 56 that is sealed by gravel pack set packer 82 at its upper or upstream end. Additionally, annulus 86 extends downwardly or downstream through the open hole of wellbore 32 and outer tubing string 56. Another annulus 88 is formed between outer tubing string 56 and a working string referred to herein as an inner tubing string 84. Inner tubing string 84 further includes an inner central passageway 100 for flowing a treatment fluid such as a fracpack or gravel pack fluid slurry referred to herein as a proppant slurry 90 to a particular zone of interest, as further described herein.

As shown, the present open hole fracpack mechanism 80 includes a shrouded closing sleeve 91. Shrouded closing sleeve 91 includes shroud 92, one or more frac ports 94 and a sliding sleeve 96. Shroud 92 is disposed concentrically about the outer surface of outer tubing string 56. Preferably, shroud 92 provides an annular region or other passageway or passageways, which is referred herein as channel 98, between the outer surface of outer tubing string 56 and the inner surface of shroud 92.

Frac ports 94 are disposed through outer tubing string 56, thus providing a passageway for proppant slurry 90 to flow into channel 98 of shroud 92. As can be seen, shroud 92 is attached, affixed, formed or may be integral with outer tubing string 56 just above or upstream of frac ports 94, thus providing a pathway for proppant slurry 90 to flow outward from frac ports 94, through channel 98 and downward or downstream to opening 154 of shroud 92.

Figure 2A:
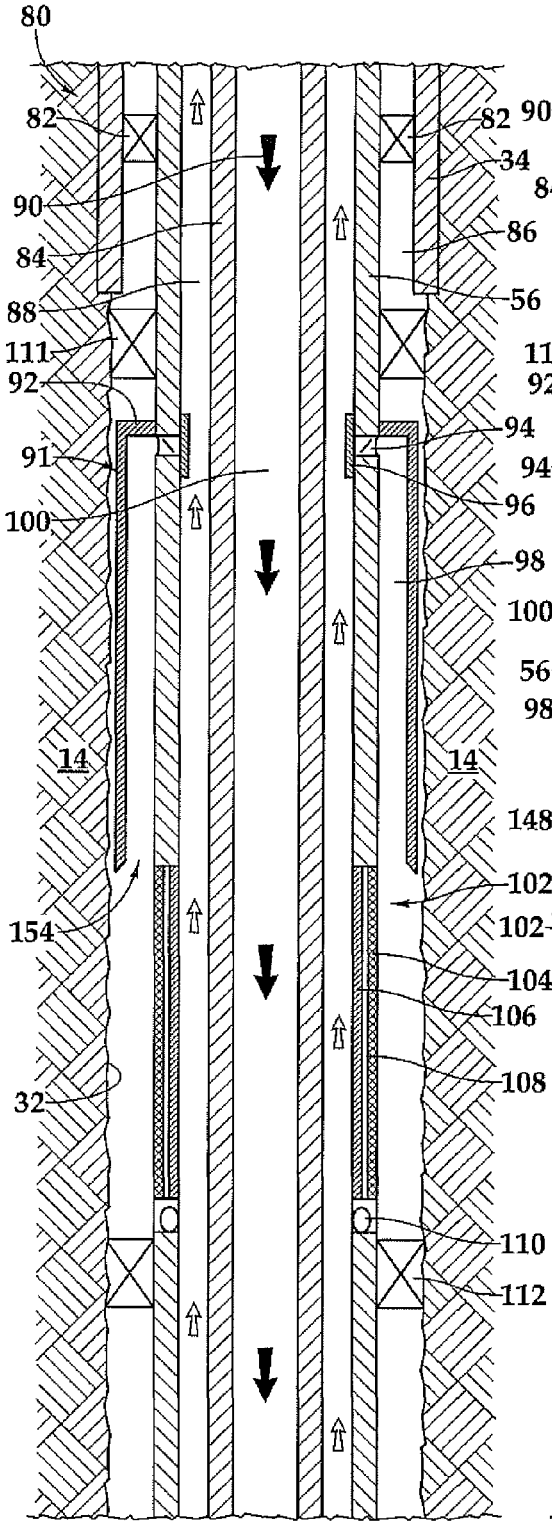
FIGS. 2A-2B are cross-sectional views of one embodiment of an open hole completion apparatus embodying principles of the present invention operating in a first zone of interest of a wellbore.

Open hole fracpack mechanism 80 further includes a closing sleeve 96 that is slidably positioned or disposed between outer tubing string 56 and inner tubing string 84 such that it may be actuated to move relative to frac ports 94 for opening and closing the passageway provided by frac ports 94. As illustrated in FIG. 2A, frac ports 94 are shown in a closed position.

Open hole fracpack mechanism 80 further includes a sand control screen assembly 102 for filtering proppant from proppant slurry 90. Sand control screen assembly preferably includes a screen portion 104 and a base pipe 106 that may provide a channel 108 therebetween such that filtered fluid 148 is transmitted to one end of sand control screen assembly 102 where a valve 110 is located. The upstream or upper end of sand control screen assembly is shown located substantially proximal to opening 154 of shroud 92. As shown in FIG. 2A, valve 110 of sand control screen assembly 102 is in a closed position.

Open hole fracpack mechanism 80 also includes a pair of packers 111, 112 for sealing annulus 86 to provide zonal isolation. Packers 111, 112 may be any type of packer commonly used and known by those skilled in the art, however, swellable packers that expand upon contact with an activation fluid may be preferred in the open hole environment due to the non-uniform and uneven surface of the formation.

Figure 2B:
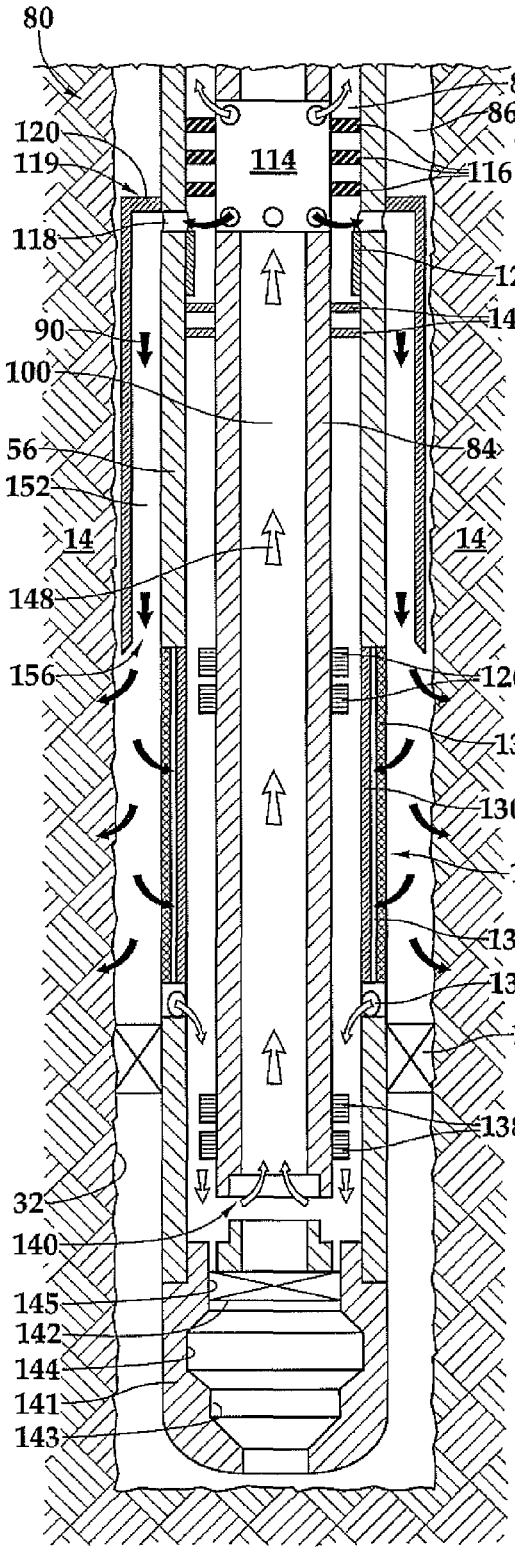

In a lower portion of the illustrated open hole fracpack mechanism 80, as best seen in FIG. 2B, fracpack mechanism 80 includes a shrouded closing sleeve 119. Similar to shrouded closing sleeve 91, shrouded closing sleeve 119 includes shroud 120, one or more frac ports 118 and a sliding sleeve 122. Shroud 120 is disposed concentrically about the outer surface of outer tubing string 56. Preferably, shroud 120 provides an annular region or other passageway or passageways, which is referred herein as channel 152, between the outer surface of outer tubing string 56 and the inner surface of shroud 120.

Frac ports 118 are disposed through outer tubing string 56, thus providing a passageway for proppant slurry 90 to flow into channel 152 of shroud 120. As can be seen, shroud 120 is attached, affixed, formed or may be integral with outer tubing string 56 just above or upstream of frac ports 118, thus providing a pathway for proppant slurry 90 to flow outward from frac ports 118, through channel 152 and downward or downstream to opening 156 of shroud 120.

Closing sleeve 122 is slidably positioned or disposed between outer tubing string 56 and inner tubing string 84 such that it may be actuated to move relative to frac ports 118 for opening and closing the passageway provided by frac ports 118. As illustrated in FIG. 2B, frac ports 118 are shown in an open position.

Open hole fracpack mechanism 80 further includes a sand control screen assembly 128 for filtering proppant 150 from proppant slurry 90. Sand control screen assembly 128 preferably includes a screen portion 132 and a base pipe 130 that may provide a channel 131 therebetween such that filtered fluid 148 is transmitted to one end of sand control screen assembly 128 where a valve 134 is located. The upstream or upper end of sand control screen assembly 128 is shown located substantially proximal to opening 156 of shroud 120. As shown in FIG. 2B, valve 134 of sand control screen assembly 128 is in an open position.

Open hole fracpack mechanism 80 also includes a pair of packers 112, 136 for sealing annulus 86 and to provide zonal isolation. Packers 112, 136 may be any type of packer commonly used and known by those skilled in the art, however, swellable packers the expand upon contact with an activation fluid may be preferred in the open hole environment due to the non-uniform and uneven surface of the formation.

Open hole fracpack mechanism 80 includes a crossover assembly 114 positioned within inner tubing string 84. Crossover assembly 114 may be selectable to move fluids, such as proppant slurry 90 from inner central passageway 100 to annulus 88, for example. Crossover assembly 114 may also be selectable to move fluids from inner central passageway 100 to annulus 86 as further described below. Preferably, crossover assembly 114 is sealed against outer tubing string 56 by one or more seal elements 116 to provide a fluid tight engagement therebetween. In the illustrated embodiment, three seal elements 116 are shown; however, any number of seal elements may be used. In addition, open hole fracpack mechanism 80 includes one or more seal elements 146 slidably disposed between inner tubing string 84 and outer tubing string 56. In this manner, proppant slurry 90 flowing from crossover assembly 114 is forced through frac ports 118.

In FIG. 2B, crossover assembly 114 is shown substantially adjacent to frac ports 118 such that ports of crossover assembly 114 provides proppant slurry 90 from inner central passageway 100 through crossover assembly 114 to frac ports 118. As shown in FIG. 2B, closing sleeve 122 is in an open position, which enables proppant slurry 90 to cross through inner tubing string 84 and flow through frac ports 118 into channel 152 provided by shroud 120. Proppant slurry 90 then flows downstream or downwardly into the wellbore region surrounding sand control screen assembly 128. In the initial portions of the fracpack operation, a surface valve associated with annulus 88 may be closed or choked to prevent or limit fluid returns. As such, proppant slurry 90 is forced into formation 14 creating fractures 148, as best seen in FIG. 3B.

Once the fracture stimulation portion of the treatment process is complete, the surface valve may be open such that fluid returns may be taken, as best seen in FIGS. 2A-2B.

As shown in FIG. 2B, inner tubing string 84 preferably has an open end 140 for receiving filtered fluid 148. As discussed further below, open end 140 may be provided after running inner tubing string 84 into wellbore 32 and then performing lifting operations on inner tubing string 84 to separate it from a plug 142 and a float shoe 141. Inner tubing string 84 may further include shifters 138 and 126 for opening and valves 110, 134 and closing sleeves 96, 122, respectively.

As noted above/open hole fracpack mechanism 80 may include any number of shrouds 92, 120 and they preferably include a portion that extends radially outwardly from outer tubing string 56. They may be sealed, formed, fastened, or otherwise affixed to the outer surface of outer tubing string 56 at a location that is proximal but upstream of frac ports 94, 118. As noted above, they may extend radially outward from this point where they are sealed or joined to outer tubing string 56. This radial extension may be substantially perpendicular or slanted relative to outer tubing string 56.

The longitudinal portion of shrouds 92, 120 extends from this point downwardly or downstream to a point that is substantially proximal to sand control screen assemblies 102, 128, respectively. The longitudinal portion of shrouds 92, 120 extend substantially parallel to wellbore 32 to a point where the openings 154, 156 are proximal to a zone of interest. For example, the zones of interest relative to FIGS. 2A-2B are those portions of wellbore 32 that are substantially adjacent to sand control screen assemblies 102, 128. Shrouds 92, 120 provide a barrier that prevents proppant slurry 90 from contacting the surface of wellbore 32 prior to exiting openings 154, 156 in their respective zone of interest. By doing so they prevent proppant slurry 90 from dehydrating into formation 14 in a manner which may cause sand bridging at or near frac ports 94, 118 that may cause inner tubular 84 to become stuck in outer tubular 56.

It should be understood by those skilled in the art that the longitudinal portions of the shrouds of the present invention may be any length desired so long as they are of sufficient length to inject the proppant slurry to a location in the wellbore that is remote from the frac ports of the shrouded closing sleeves, i.e., a location in the wellbore sufficiently distant from the frac ports that dehydration of the proppant slurry does not occur at or near the frac ports. For example, the length of the longitudinal portions of shrouds of the present invention may extend for several sections of tubing making up the outer tubing string or may be only a few feet, depending on factors such as completion string configuration, formation characteristics, the type of proppant slurry to be pumped, the flow rate and pressure at which the proppant slurry will be delivered and the like.

Shrouds 92, 120 may be formed separately and then affixed to outer tubing string 56 prior to running it into wellbore 32. In another example, shrouds 92, 120 may be formed as a unitary part of outer tubing string 56. Generally, shrouds 92, 120 are of a substantially cylindrical shape reflecting the outer tubing string 56 in which they are disposed about. Preferably, they are thin-walled and made from a material, such as steel, that is sufficiently rigid to run into wellbore 32 along with outer tubing string 56 without becoming deformed.

In one embodiment, closing sleeves 96, 122 may be actuated by lifting or otherwise moving inner tubing string 84 upstream such that shifters actuate closing sleeves 96, 122. In another embodiment, closing sleeves 96, 122 may be actuated remotely by wired or wireless communication to a remote motor or actuator, for example.

Seal elements 116, 146 may consist of any suitable sealing element or elements, such as a packing stack with one or more O-rings either alone or in combination with backup rings and the like. In various embodiments, seal elements 116, 146 may comprise AFLAS® O-rings with PEEK back-ups, Viton® O-rings, nitrile O-rings or hydrogenated nitrile O-rings or other suitable seal.

Referring collectively to FIGS. 2A-2B and 3A-3B the operation of open hole fracpack mechanism 80 will now be described. In the following, open hole fracpack mechanism 80 is being described in the context of a fracpacking operation, but as discussed further below, open hole fracpack mechanism 80 is also well suited for use in gravel packing operations and processes. Open hole fracpack mechanism 80 is shown before and after fracpacking of a first zone of interest. In operation, open hole fracpack mechanism 80 of FIGS. 2A-2B may be run into wellbore 32 in a single trip or multiple trips on inner tubing string 84 and outer tubing string 56 to a desired depth. The gravel pack set packer 82 is then set against casing 34. In one embodiment, inner tubing string 84 and outer tubing string 56 are run into wellbore 32 with closing sleeve 96, valve 110, closing sleeve 122, and valve 134 in a closed position. Additionally, at this time packers 111, 112 and 136 may also be set by contacting them with a fluid to cause these packers to swell and seal against formation 14 of wellbore 32.

When inner tubing string 84 is initially run into wellbore 32, a float shoe 141 is attached to its lower end. In the illustrated embodiment, inner tubing string 84 may be attached to float shoe 141 using plug 142, which initially provides a seal in a profile 143 and is preferably coupled to float shoe 141 with pins or other suitable attachment members. After this assembly is positioned at the desired depth, outer tubing string 56 may be run to its desired depth and attached to the upper end of float shoe 141. Once in this configuration, a downward force on inner tubing string 84 may be used to shear the pins, thus freeing plug 142 from float shoe 141. Inner tubing string 84 may now move upwardly within outer tubing string 56. Preferably, inner tubing string 84 is moved upwardly to position plug 142 in the radially expanded region 144 of float shoe 142. In this position, fluid may be circulated through float shoe 141 as desired. Once packers 112 and 136 are set, inner tubing string 84 is moved upwardly to position plug 142 in profile 145 providing a seal therein. Further upward movement inner tubing string 84 releases plug 142, as best seen in FIG. 2B. By shearing inner tubing string 84 from plug 141, open end 140 is opened for receiving filtered fluid 148. Additionally, by setting plug 142 in profile 145, a sealed bottom environment is provided for preventing filtered fluid 148 from leaking off into formation 14 of wellbore 32.

In one embodiment, inner tubing string 84 may be further lifted or picked up further such that shifter 126 opens closing sleeve 122 and shifter 138 opens valve 134. Once these elements are opened, inner tubing string 84 may be lowered downstream to a position as best seen in FIGS. 2A-2B. In one embodiment, these lifting and lowering operations may operate or actuate crossover assembly 114 into a position to enable the fluid flow paths as shown in FIGS. 2A-2B.

During the lowering operation, seal elements 116 and seal elements 146 seal between inner tubing string 84 and outer tubing string 56. Proppant slurry 90 is then pumped down inner central passageway 100 to crossover assembly 114 where it crosses over to channel 152 via opened closing sleeve 122 and frac ports 118. Proppant slurry 90 then flows between shroud 120 and outer tubing string 56 as shown in FIG. 2B where it exits channel 152 at opening 156. After exiting opening 156, proppant slurry 90 then contacts formation 14 and, in one embodiment, fractures formation 14 through the use of a surface valve to prevent or limit fluid returns. During the fracture process, high pressure and high flow rate proppant slurry 90 is pumped into formation 14 creating fractures 148, as best seen in FIG. 3B. When it is desired to end the fracture portion of the fracpack, the surface valve is open to allow fluid returns.

The proppant 150 contained within proppant slurry 90 is now deposited or packed between formation 14 and sand control screen assembly 128, the results of which are depicted in FIG. 3B. The fluid portion of proppant slurry 90 is filtered through sand control screen assembly 128. Filtered fluid 148 then flows to opened port 134 where it exits and flows into annulus 88 and then toward open end 140 of inner tubing string 84. Filtered fluid 148 then flows up through inner central passageway 100 toward crossover assembly 114 where it crosses over to annulus 88 and then flows further upward or upstream where it may exit annulus 88 into annulus 86 via an exit port (not shown) located above gravel pack set packer 82, for example. This operation may continue until a desired amount of proppant 150 has been deposited or packed between sand control screen assembly 128 and formation 14, as best seen in FIG. 3B.

Figure 3A:
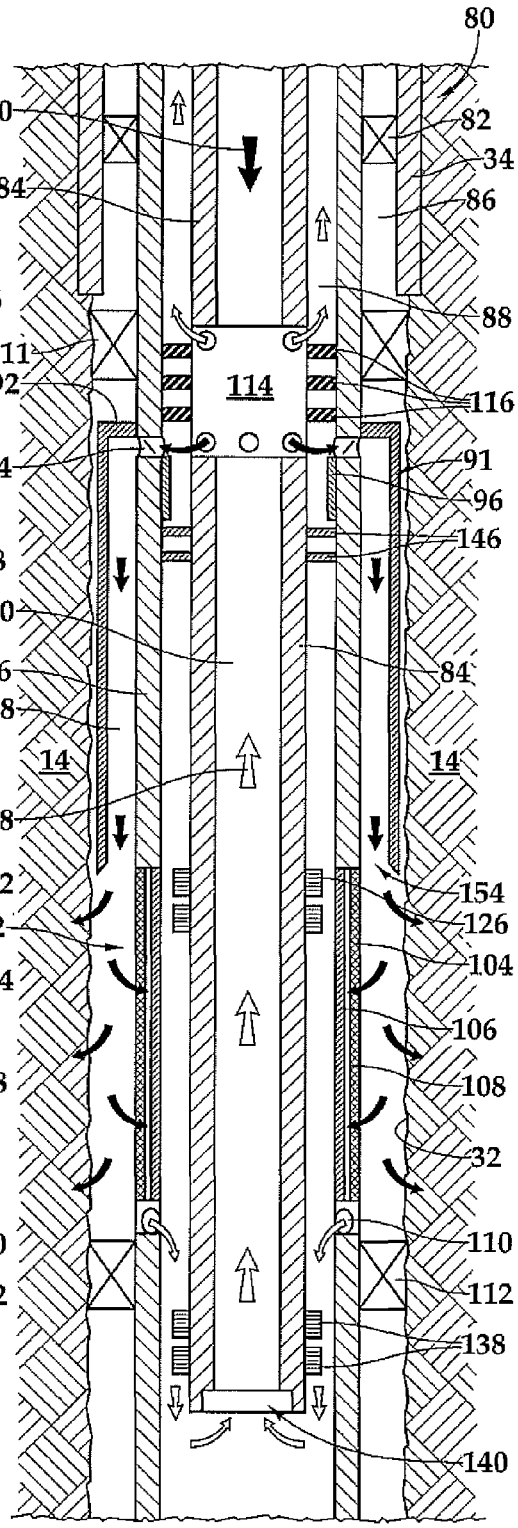
FIGS. 3A-3B are cross-sectional views of one embodiment of an open hole completion apparatus embodying principles of the present invention operating in a second zone of interest of the wellbore.
Figure 3B:
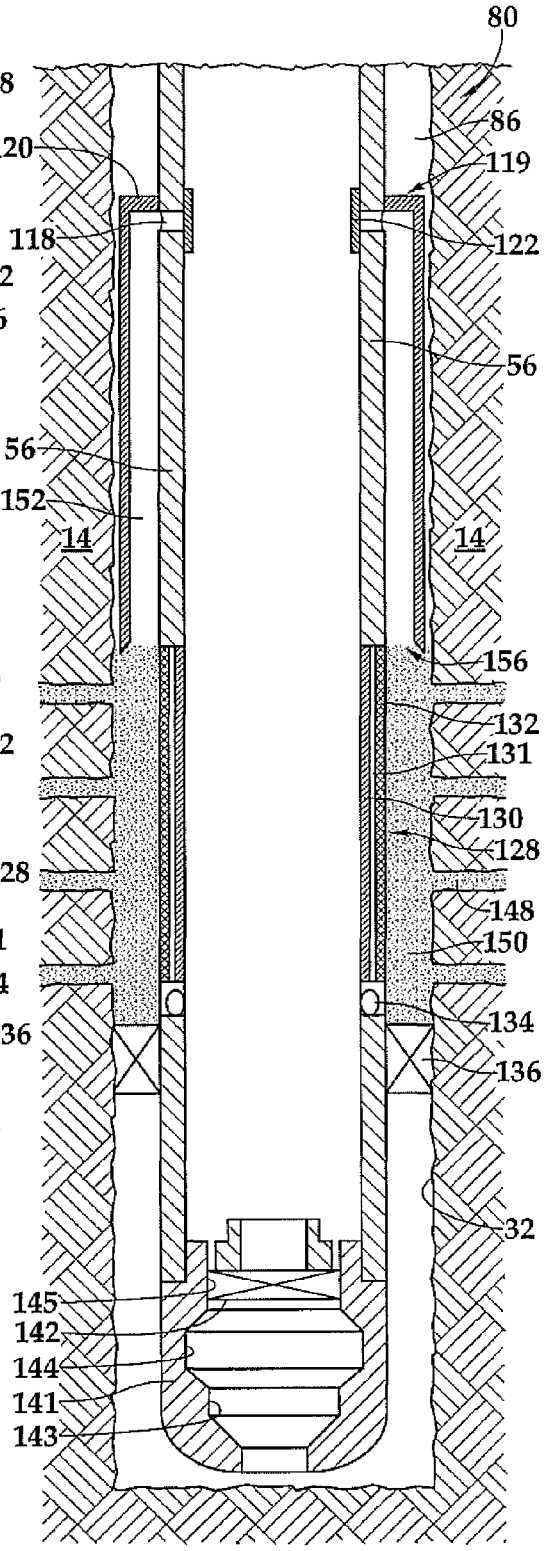

Once a first zone of interest has been treated, inner tubing string 84 may be picked up or lifted to the next zone of interest as best seen in FIGS. 3A-3B. Inner tubing string 84 is lifted such that shifter 126 and shifter 138 close closing sleeve 122 and valve 134 and open closing sleeve 96 and valve 110, respectively. The operations as discussed above may then be repeated to fracpack the second zone of interest. Specifically, proppant slurry 90 is then pumped down inner central passageway 100 to crossover assembly 114 where it crosses over to channel 98 via opened closing sleeve 96 and frac ports 94. Proppant slurry 90 then flows between shroud 92 and outer tubing string 56 as shown in FIG. 3A where it exits channel 98 at opening 154. After exiting opening 154, proppant slurry 90 then contacts formation 14 and, in one embodiment, fractures formation 14 through the use of a surface valve to prevent or limit fluid returns. During the fracture process, high pressure and high flow rate proppant slurry 90 is pumped into formation 14 creating fractures. When it is desired to end the fracture portion of the fracpack, the surface valve is open to allow fluid returns.

The proppant contained within proppant slurry 90 is now deposited or packed between formation 14 and sand control screen assembly 102 (not shown). The fluid portion of proppant slurry 90 is filtered through sand control screen assembly 102. Filtered fluid 148 then flows to opened port 110 where it exits and flows into annulus 88 and then toward open end 140 of inner tubing string 84. Filtered fluid 148 then flows up through inner central passageway 100 toward crossover assembly 114 where it crosses over to annulus 88 and then flows further upward or upstream where it may exit annulus 88 into annulus 86 via an exit port (not shown) located above gravel pack set packer 82, for example. This operation may continue until a desired amount of proppant has been deposited or packed between sand control screen assembly 102 and formation 14.

Although, the above operations have been described relative to a fracpacking operation, the present open hole fracpack mechanism 80 may be used in gravel packing operations as well. In one embodiment, shrouds 92, 120 direct proppant slurry 90 to substantially the top or upstream portion of sand control screen assembly 128 and sand control screen assembly 102, respectively, but fluid returns are allowed during the entire operation resulting in the packing of the wellbore regions surrounding sand control screen assembly 128 and sand control screen assembly 102 without fracturing the formation.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An open hole completion apparatus for use in a wellbore, comprising:

an outer tubing string at least partially disposed in an open hole portion of the wellbore, the outer tubing string including at least one sand control screen and a closing sleeve having at least one fluid port;

an inner tubing string at least partially disposed within the outer tubing string, the inner tubing string including a crossover assembly having at least one fluid port that is selectively in fluid communication with the at least one fluid port of the closing sleeve; and a shroud disposed around at least a portion of the outer tubing string and forming a channel therewith that extends over the at least one fluid port of the closing sleeve toward the at least one sand control screen, the shroud having a discharge end located between the at least one fluid port of the closing sleeve and the at least one sand control screen such that when a treatment fluid is pumped through the inner tubing string, the crossover assembly and the at least one fluid port of the closing sleeve, the treatment fluid is injected into the wellbore from the at least one fluid port of the closing sleeve and uphole and outside of the at least one sand control screen.

2. The apparatus as recited in claim 1 wherein the outer tubing string further comprises first and second packers disposed respectively uphole and downhole of the at least one sand control screen and the closing sleeve.

3. The apparatus as recited in claim 1 wherein the closing sleeve further comprises a sleeve operable to allow and prevent fluid communication between the at least one fluid port of the crossover assembly and the at least one fluid port of the closing sleeve.

4. The apparatus as recited in claim 3 wherein the inner tubing string is operable to open and close the sleeve.

5. The apparatus as recited in claim 1 wherein the shroud directs the treatment fluid in a downhole direction in the channel.

6. The apparatus as recited in claim 1 wherein the channel is substantially annular.

7. The apparatus as recited in claim 1 wherein the shroud further comprises a thin-walled tubular member.

8. The apparatus as recited in claim 1 wherein the treatment fluid further comprises a fracpack fluid slurry.

9. The apparatus as recited in claim 1 wherein the inner tubing string is initially connected to a float shoe.

10. An open hole completion apparatus comprising:

a tubing string;

a closing sleeve coupled within the tubing string, the closing sleeve having at least one fluid port through a side wall portion thereof and a sleeve operable to allow and prevent fluid communication through the at least one fluid port;

at least one sand control screen coupled within the tubing string; and a shroud disposed around at least a portion of the tubing string and forming a channel therewith that extends over the at least one fluid port of the closing sleeve toward the at least one sand control screen, the shroud having a discharge end located between the at least one fluid port and the at least one sand control screen such that a treatment fluid exiting the shroud is injected into the wellbore from the at least one fluid port of the closing sleeve and uphole and outside of the at least one sand control screen.

11. The open hole completion apparatus as recited in claim 10 wherein the shroud directs a treatment fluid in a downhole direction in the channel when the completion assembly is operably positioned in the wellbore.

12. The open hole completion apparatus as recited in claim 10 wherein the channel is substantially annular.

13. The open hole completion apparatus as recited in claim 10 wherein the shroud further comprises a thin-walled tubular member.

14. A method for completing an open hole wellbore comprising:

disposing a completion apparatus in the wellbore, the completion apparatus including an outer tubing string and an inner tubing string, the outer tubing string including a pair of packers, a closing sleeve having at least one fluid port through a side wall portion thereof and at least one sand control screen, the inner tubing string having a crossover assembly;

setting the packers to isolate at least one zone;

pumping a treatment fluid through the inner tubing string, the crossover assembly and the at least one fluid port of the closing sleeve;

directing the treatment fluid away from the at least one fluid port in a channel between a shroud and at least a portion of the outer tubing string, the shroud extending over the at least one fluid port toward the at least one sand control screen, the shroud having a discharge end located between the at least one fluid port and the at least one sand control screen; and injecting the treatment fluid into the wellbore from the at least one fluid port and uphole of the at least one sand control screen.

15. The method as recited in claim 14 wherein pumping a treatment fluid further comprises pumping a fracpack fluid slurry.

16. The method as recited in claim 14 wherein pumping a treatment fluid further comprises pumping a gravel pack fluid slurry.

17. The method as recited in claim 14 wherein directing the treatment fluid away from the at least one fluid port in a channel between a shroud and at least a portion of the outer tubing string further comprises directing the treatment fluid away from the at least one fluid port in an annular region between the shroud and at least a portion of the outer tubing string.

18. The method as recited in claim 14 wherein injecting the treatment fluid into the wellbore remote from the at least one fluid port further comprises preventing dehydration of the treatment fluid proximate the at least one fluid port.

19. The method as recited in claim 14 further comprising deploying a float shoe prior to setting the packers.

* * * * *